US008161774B2

(12) United States Patent
Stingel et al.

(10) Patent No.: US 8,161,774 B2
(45) Date of Patent: Apr. 24, 2012

(54) FLOATING STITCH NEEDLE FOR A CROCHET GALLOON MACHINE

(75) Inventors: Uwe Stingel, Messstetten (DE); Andreas Kuntsmann, Überlingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/965,204

(22) Filed: Dec. 10, 2010

(65) Prior Publication Data

US 2011/0138862 A1 Jun. 16, 2011

(30) Foreign Application Priority Data

Dec. 16, 2009 (EP) ..... 09015525

(51) Int. Cl.
*D04B 35/08* (2006.01)

(52) U.S. Cl. ..... 66/119

(58) Field of Classification Search ..... 66/116, 66/119, 85 A, 85 R, 117
See application file for complete search history.

(56) References Cited

U.S. PATENT DOCUMENTS

| | | | | |
|---|---|---|---|---|
| 1,652,308 | A * | 12/1927 | Howie | 66/18 |
| 2,318,586 | A | 5/1943 | Amidon | |
| 4,007,609 | A | 2/1977 | Zorini | |
| 4,417,455 | A | 11/1983 | Durville | |
| 4,603,561 | A * | 8/1986 | Berger et al. | 66/203 |
| 5,619,868 | A * | 4/1997 | Schmoll et al. | 66/119 |
| 2011/0138862 | A1 * | 6/2011 | Stingel et al. | 66/116 |

FOREIGN PATENT DOCUMENTS

| | | |
|---|---|---|
| DE | 2521910 | 12/1975 |
| DE | 2930824 | 1/1981 |
| DE | 3447281 | 6/1986 |
| DE | 4417692 | 11/1995 |

* cited by examiner

*Primary Examiner* — Danny Worrell
(74) *Attorney, Agent, or Firm* — Fitch, Even, Tabin & Flannery, LLP; Norman N. Kunitz

(57) ABSTRACT

A crochet galloon machine needle (26) in accordance with the invention is provided on its hook outside (39) with a guide projection (40) having a tip (43) that is preferably located above the center axis (A) of the needle (26). This needle (26) has an enlarged weft thread capture range and is thus particularly suitable for the manufacture of dense knitted goods. In addition, said needle enables the operation with reduced take-off tension and, optionally, also with reduced weft thread tension. This helps increase the service life of all system components.

7 Claims, 5 Drawing Sheets

FLOATING STITCH NEEDLE FOR A CROCHET GALLOON MACHINE

CROSS-REFERENCE TO RELATED APPLICATION

The present application claims the priority of European Patent Application No. 09 015 525.0, filed Dec. 16, 2009, the subject matter of which, in its entirety, is incorporated herein by reference.

BACKGROUND OF THE INVENTION

The invention relates to a crochet galloon machine needle, i.e., a floating stitch needle, that is specifically intended for use in a crochet galloon machine.

Crochet galloon machines are special machines for the production of textile webs such as, for example, bands or ribbons for belts, mattress bands, zipper bands, bands or ribbons for straps of, e.g., brassieres, elastic bandages, gauze bandages or the like.

A crochet galloon machine for the production of textile webs has been known, for example, from publications DE 44 17 692 A1 and DE 29 30 824 A1. The machine comprises a group of needles that are moved in synchrony back and forth in longitudinal direction, the end of each of said needles bearing a hook with resilient legs. The needles produce knitted or crocheted goods that consist, e.g., of small stitch wales or stitch loops that are also referred to as "closed fringe". To accomplish this, a group of guide needles that are moved in synchrony first place at least one ground thread and, optionally, also an additional elastic thread. In addition, a thread guide is provided, said thread guide feeding an underlying so-called weft thread transversely with respect to the thread forming the stitch chain or inserting said weft thread in a back-and-forth moving manner. This weft thread binds itself in the stitch chains.

Such a crochet galloon machine requires high take-off forces in order to operate properly. The take-off forces pull the textile web away from the needles and thus stretch the half-stitches, that are still hanging in the needles, in order to provide enough room for the reliable insertion of the weft thread and in order to ensure that the newly formed stitches will not be thrown off. As the density of the good increases, the material take-off tension must be reduced in order to produce the small stitches that are necessary for high material density. Considering flat textiles displaying high material density, the distance of the stitch head of a produced stitch from the stitch ground of the half stitch in the needle hook is very small and, in some instances, almost equal to zero. This makes a reliable underlayment of the weft thread between the stitch head of the produced stitch and the stitch ground of the half stitch difficult. Depending on the pattern of the textile web that is to be produced, a weft thread may connect all the stitch chains or only a part of the stitch chains of a web. In the latter case, the weft thread is referred to as a partial weft thread.

Considering this, it is the object of the invention to provide improved systems components that enable the manufacture of textile webs with high material density in a reliable and consistent manner.

SUMMARY OF THE INVENTION

The above object generally is achieved with a crochet galloon machine needle in accordance with the invention that has a hook that delimits an inside space of the hook. A guide projection is formed on the outside of the hook, said outside facing away from the shank. This guide projection extends like a nose away from the outside of the hook. This projection is disposed to guide the weft thread into its assigned position in the knitted goods, when said weft thread is being inserted. Due to the inventive guide projection on the crochet galloon machine needle, the thread tension of the weft thread can be reduced and a reliable and consistent underlayment of the weft thread can still be ensured.

Even with reduced take-off tension, the guide projection ensures that the weft thread reaches the desired weft thread position when it is fed and the needles are driven. This applies, in particular, to highly dense textiles that could otherwise no longer be produced in a secured manner due to the process-specific reduction of the take-off tension.

Due to the necessary reduction of the take-off tension for the production of knitted goods displaying increased stitch density, the forces acting on the crochet galloon machine needle decrease considerably. Correspondingly, the thread tensile forces when the thread is being fed must be adapted to the changed conditions, so that the forces acting on the guide needles or on other elements (system components) involved in the stitch forming process can be varied.

In a specific embodiment, the inside of the hook is curved in the form of a circle around a center located in the in the inside space of the hook. The outside contour on the outside of the hook, however, deviates from this circular arc form. The guide projection arranged here preferably has at least one straight ramp that extends from the tip of said projection to an underside of the hook, whereby said underside may also be viewed as the back of the needle. The ramp on the guide projection is preferably straight. However, it may also have a different form such as, for example, an S-form or the like. In transverse direction, the ramp is preferably rounded, so that it terminates—without sharp edges—in the flanks of the guide projection and of the hook.

The guide projection may have a straight upper side, for example. Preferably, both the upper side and the ramp are inclined at an angle against a center axis that is consistent with the longitudinal direction of the needle. In doing so, the angle included between the upper side and the center axis is preferably smaller than the angle included between the ramp and the center axis.

Independent of its remaining form, the guide projection has a tip facing away from the shank. This tip is preferably rounded. Preferably, the rounding is spherical. The rounding radius is preferably smaller than the rounding radius of the inside of the hook. The tip is preferably arranged above the center axis extending through the center of curvature of the inside of the hook. As a result of this, the guide projection is provided with a distinct ability to effectively guide the weft thread.

As mentioned, both the upper side and the ramp may be straight. The imaginary roofed extension of these edges preferably intersects in a point located above the center axis extending through the center of curvature of the inside contour of the hook. As a result of this, the ramp is provided with a large capture range, within which said ramp is able to guide an impinging weft thread to the underside of the needle.

The flanks of the guide projection may be disposed to be parallel to each other or to converge toward each other. In addition, they may be having a flat configuration or a contour that is different from the flat form. Preferably, the guide projection has a thickness of at least approximately 20% to 30% of the needle thickness.

Additional details of advantageous embodiments of the invention are implicit in the drawings, the description or the claims hereinafter. In doing so, the description is restricted to essential aspects of the invention and a few miscellaneous situations. The drawings are to be used as a supplementary reference to the description.

DETAILED DESCRIPTION OF THE INVENTION

Figure 1:
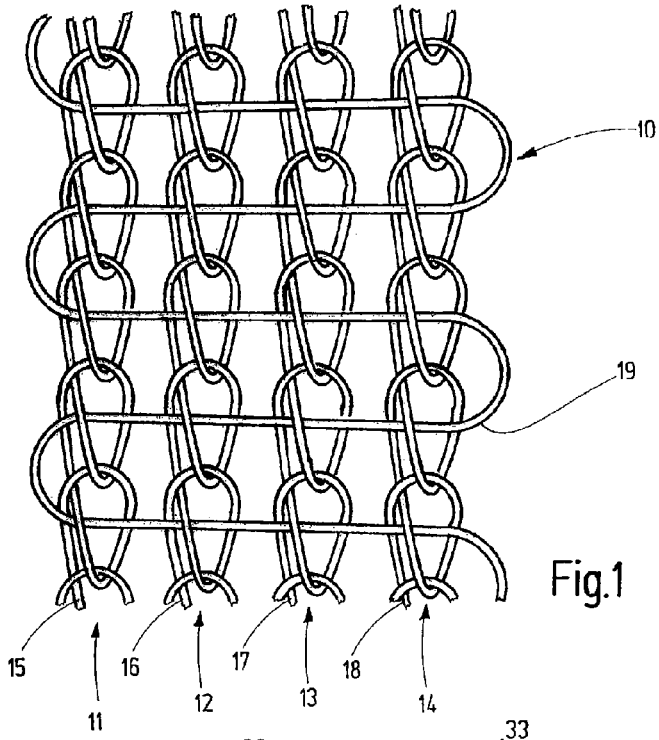
FIG. 1 is a non-plaited knitted good produced with the crochet galloon machine.

FIG. 1 shows a detail of a simple example of a web-shaped knitted good 10 produced with a crochet galloon machine. The knitted good 10 comprises several adjacently arranged stitch chains 11, 12, 13, 14 that are not looped together, each of said stitch chains being formed by its own ground thread 15, 16, 17, 18, whereby these stitch chains are also being referred to as "closed fringe". The longitudinal directions of the respective stitch chains 11, 12, 13, 14 coincide with the longitudinal direction of the textile web that is to be produced. In a direction transverse thereto, a weft thread 19 is provided, said weft thread alternately traversing through the stitch rows 11 through 14 from one edge to the other and being bound in the individual stitches. In doing so, the weft thread 19 may extend approximately at a right angle to the longitudinal direction of the web-shaped knitted good or the stitch chain 11 through 14. Consequently, the weft thread 19 always moves successively through the simultaneously generated stitches of each stitch chain 11 through 14, said stitches being located on the same level.

Figure 2:
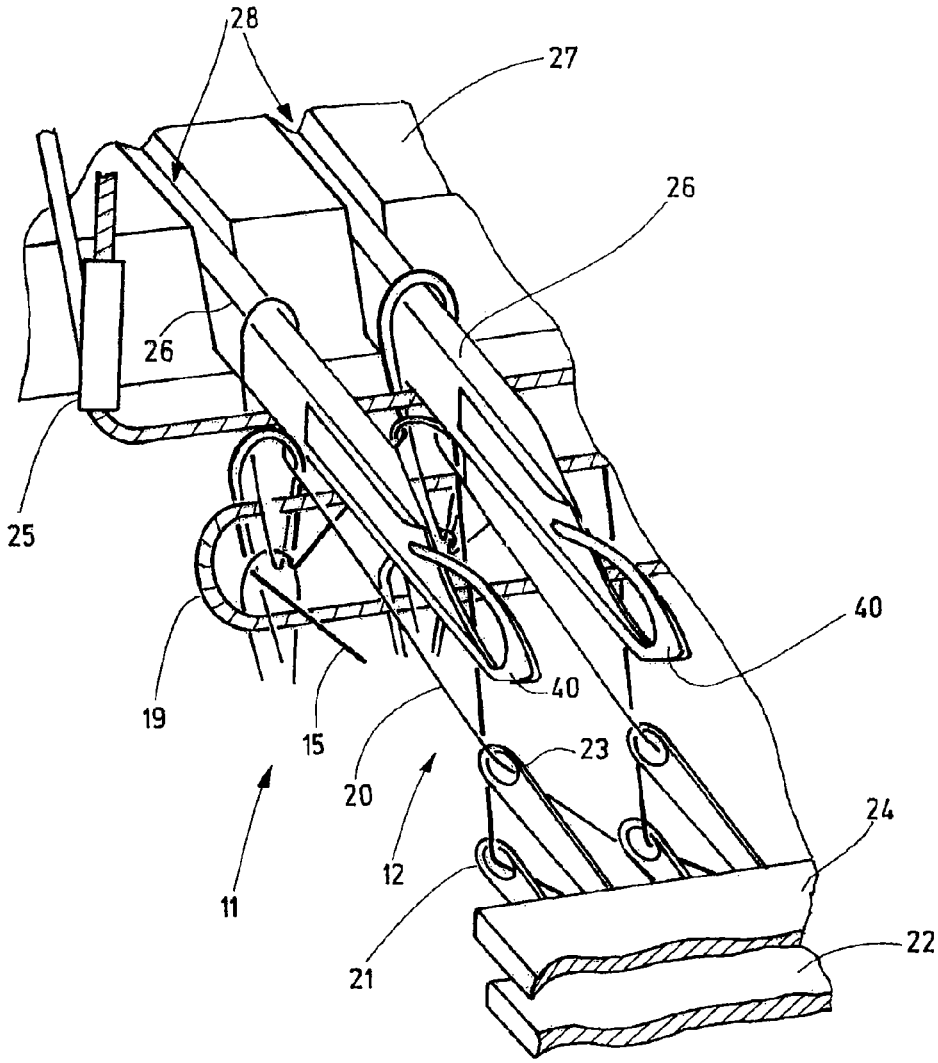
FIG. 2 is a perspective representation of a detail of a crochet galloon machine during the production of plaited knitted goods consistent with the basic idea of a knitted good in accordance with FIG. 1.

In addition to the ground thread 15, it is possible to bind an additional warp thread 20 in the knitted good, as can be seen in the first stitch row 11 of FIG. 2. For example, the ground thread 15 is a non-elastic (hard) thread, while the warp thread 20 may be an elastic (soft) thread. Furthermore, the individual stitch chains 11, 12, etc., may be looped together with each other, as is also indicated in FIG. 2. The type of binding and the ultimate, exactly achieved, stitch appearance are a function of the relative movement of the system components participating in the stitch forming process, said system components being explained hereinafter.

The stitch forming system comprises guide needles 21 that are held in a first bar 22, as well as, optionally, additional guide needles 23 that are held in a second bar 24. The first of the guide needles 21 can be provided, for example, for guiding the ground thread 15. Additional guide needles held on the same bar guide the ground threads of the other stitch chains. In contrast, the guide needle 23 is disposed to guide an additional warp thread 20. Additional guide needles of the bar 24 guide corresponding warp threads.

Furthermore, a thread guide 25 is provided for feeding the weft thread 19, said thread guide traversing once during each stitch forming process for each row of stitches from one textile web edge to the other and, in doing so, placing the weft thread on the just-formed half stitches.

Furthermore, the stitch forming system comprises crochet galloon machine needles, hereinafter briefly referred to as the needle(s) 26. One end of the needles 26 is held in a not specifically illustrated bar. In addition, said needles are supported in a needle bed 27 so that they can be moved back and forth in longitudinal direction of said needles. The needles 26 are supported in appropriate needle channels 54 in the needle bed 27, said needles sliding back and forth in axial direction on the bottom of said needle channels during the stitch forming process.

Among each other, the needles 26 have the same configuration so that the following description relating to one needle 26 applies analogously to all other needles 26.

Figure 3:
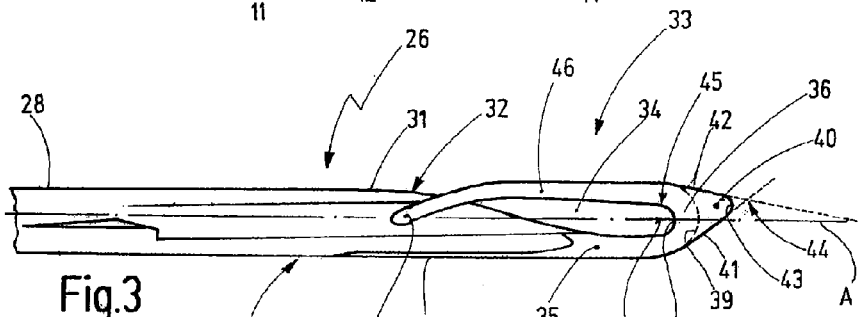
FIG. 3 is a side view of a crochet galloon machine needle of the crochet galloon machine in accordance with FIG. 2.

Considering the invention, special attention is paid to the configuration of the needle 26. Said needle is shown by itself, in particular, in FIGS. 3 and 4. The needle 26 has a shank 28 that—as shown by FIG. 3—may be straight or may also be bent toward its end that is not cut on the left side in FIG. 3 and thus no longer shown, or cranked or configured otherwise. Toward its end on the right in FIG. 3, the shank 28 terminates in a stitch forming part 29. Along the stitch forming part 29, the needle 26 has a straight lower narrow side 30, for example, said side also being referred to as the needle back.

The narrow needle upper side 31 extends from the shank, for example, initially parallel, to the narrow lower side 30 or at a slight inclination with respect to said narrow lower side. At a transition point 32, the needle upper side 31 adjoins a needle head that is configured as the hook 33 and belongs to the stitch forming part 29.

The hook 33 encloses an inside space 34 that is delimited by a straight projection 35 of the shank 28 in the direction toward the narrow lower side 30. The extension 35 terminates in a hook head 36 having an inside contour defining a hook inside 37 having the form of circular arc, for example. Said hook inside is curved, for example, in the form of an arc of a circle around a center 38. The center axis A is assumed to extend through this center 38 and extends through an imaginary center of the hook. Also, if the hook inside 37 does not have the form of a circular arc, the center axis A is centered on half the height through the hook inside 37 or centered on half the height through the inside space 34.

The hook head 36 of a crochet galloon machine needle shown in FIG. 3 has—on its imaginary hook outside 37 drawn in dashed lines in FIG. 3 with said hook outside extending at a constant distance—a guide projection 40 that extends away from the shank 28 and the hook 33. The guide projection 40 is delimited in downward direction, i.e., toward the lower side 30, by a ramp that is straight, for example, and in upward direction by an upper side 42 that is straight, for example. The ramp 41 and the upper side 42 transition into each other at a preferably rounded tip 43. This tip 43 is preferably located above the center axis A. In doing so, the radius of curvature of the tip is clearly smaller than the radius of curvature of the inside 37.

In addition, an intersection point 44 of two imaginary extensions of the ramp 41 and of the upper side 42 shown in dotted lines in FIG. 3 is preferably located above the center axis A and, in addition, preferably above a point 45 where the hook inside 37 transitions into the straight contour of a preferably elastically configured leg 46. In other words: the distance of the point 45 from the center axis A is smaller than the distance of the intersection point 44 from the center axis A.

Furthermore, the end of the leg 46 is preferably rounded. This rounding is preferably consistent with the rounding of the tip 43.

The said leg 46 is essentially straight and its one—for example, slightly bent—end 47 abuts in a resilient manner against the shank 28 or in a recess provided on said shank.

Figure 4:
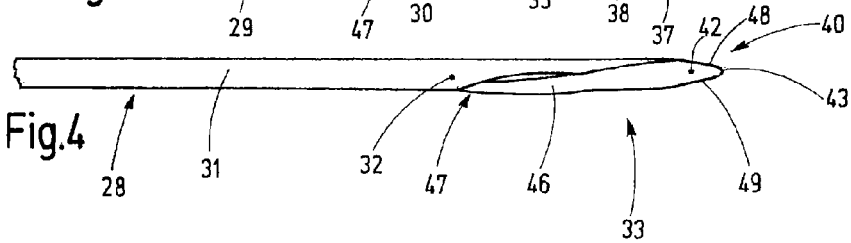
FIG. 4 is a detail, in plan view, of the crochet galloon machine needle in accordance with FIG. 3.

The guide projection 40 has two flanks 48, 49 that may represent flat surfaces, as shown by FIG. 4. The surfaces converge, for example, toward the tip 43. However, the flanks 48, 49 may also be arc-shaped or have another shape. Furthermore, they may be parallel to each other. The flanks 48, 49 have preferably rounded edges that, for example, transition into preferably also flat surfaces of the upper side 42 and the ramp 41.

Independent of its position, form and cross-section, any known hook of a needle may be provided with a guide projection 40 in accordance with the invention.

The process of textile production will be explained hereinafter with reference to FIGS. 1 through 7 using the example of the stitch chain 11 and the weft thread 19 of FIG. 1:

To aid in understanding, it is pointed out that all the needles 26 in the needle bed 27 are synchronously moved relative to each other. Likewise, the guide needles 21 held on a common bar are moved synchronously relative to each other. The stitch forming process takes place in that the needles 26 are moved forward and backward in the manner known per se, whereby the guide needles 21 area adapted to loop the ground thread 15 around the needle in a manner known per se in order to place said ground thread in the hook 33 for the formation of stitches. Thereafter, when the needle 26 is driven out the half stitch 50—due to the high take-off force acting on the stitch chain 11—moves out of the hook 33 and onto the shank 28. The guide needle 21 then loops the ground thread 15 again around the hook 33, placing said ground thread in said hook. When the needle 26 is retracted the half stitch 50 seated on the shank 28 slides off over the hook 33, in which case the thread captured by the hook 33 is pulled through the stitch formed during this process. As a result of this, a new half stitch 50 is formed in the inside space 34 of the hook 33. The status shown in FIG. 5 is again achieved with the new half stitch 50.

Figure 5:
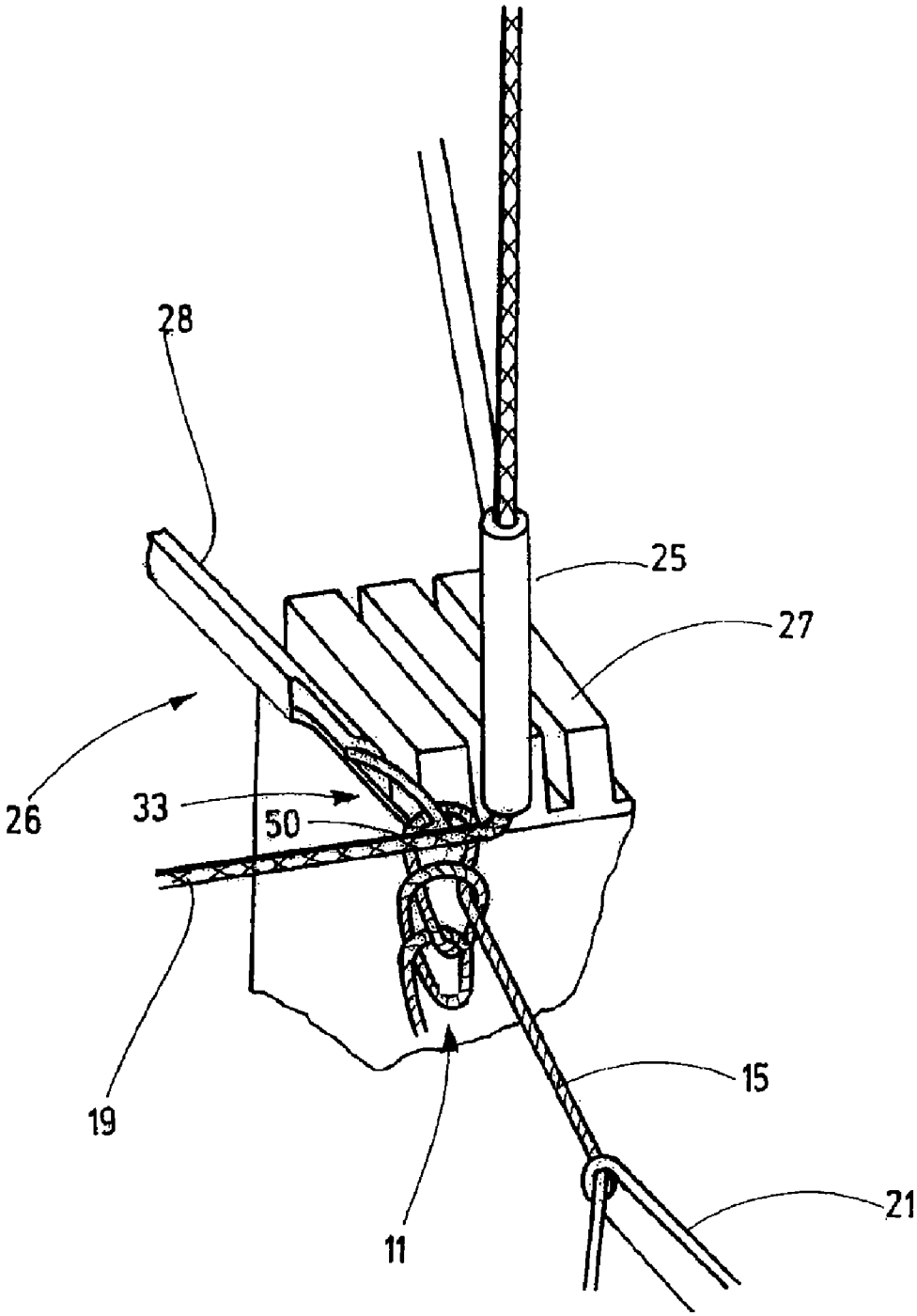
FIG. 5 and FIG. 6 are perspective views of simplified representations of details of the crochet galloon machine in accordance with FIG. 2, in various operating positions in order to illustrate the stitch forming process.
Figure 6:
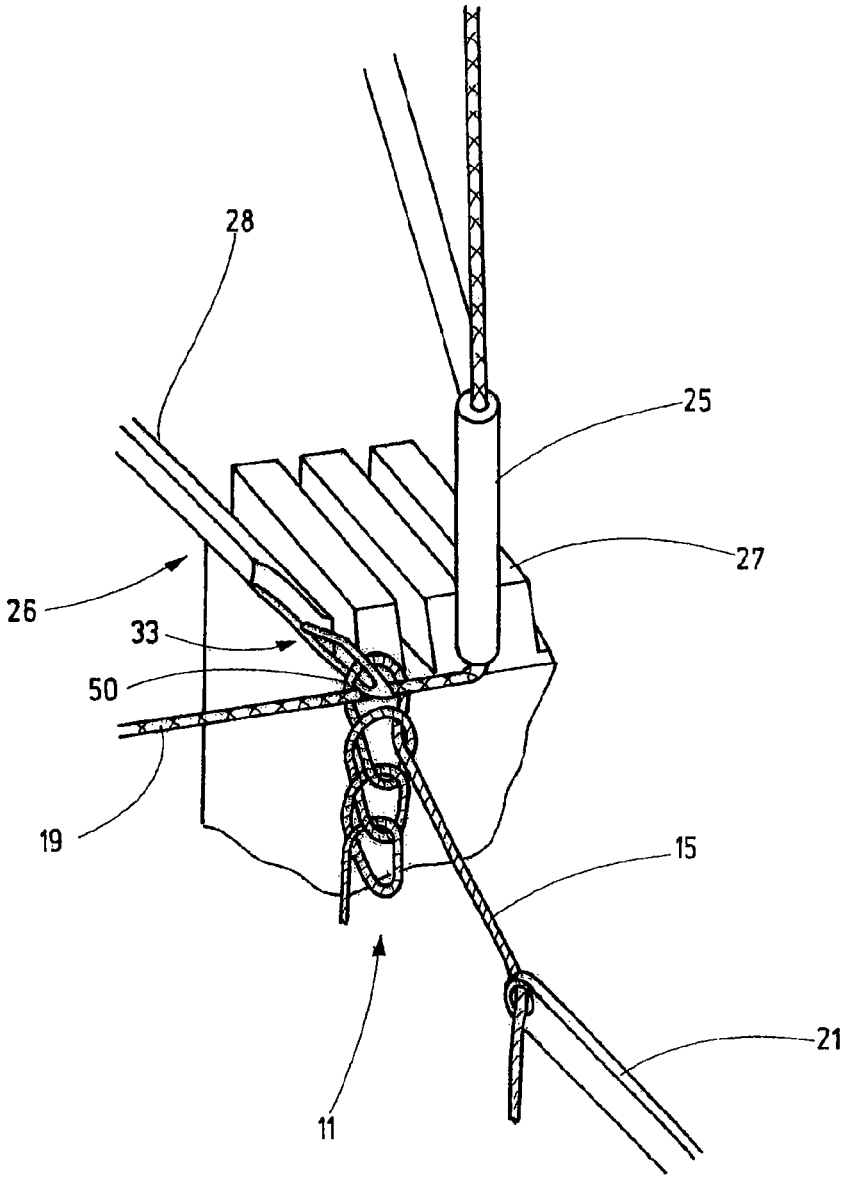
Figure 7:
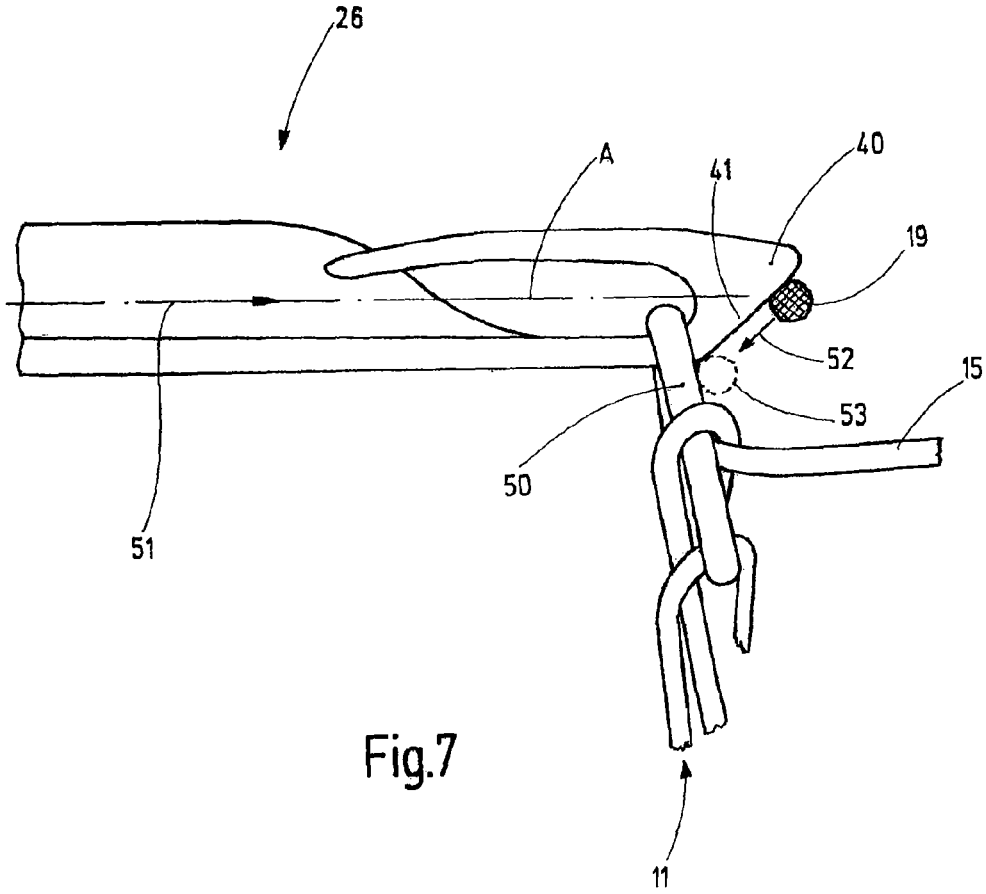
FIG. 7 is another representation of a detail of the stitch forming process in order to explain the feeding of a weft thread at low take-off tension.

Referring to the process described so far the take-off force acting on the stitch chain 11 must be dimensioned just great enough to enable the stitch forming process to proceed without error. In conjunction with this, particular attention is paid to the feeding of the weft thread 19. As is shown by FIGS. 5 and 6, said weft thread is deposited upstream or downstream of the last-generated half stitch 50. In doing so, the special form of the needle 26, in particular the effect of its guide projection 40, ensures that the weft thread 19 is guided to the desired location. This is again shown separately in FIG. 7. The part of the weft thread 19 deposited by the thread guide may impinge on the ramp 41 of the guide projection 40, for example, approximately on the level of or slightly above the longitudinally extending center axis A. When the needle 26 is driven out in the direction of arrow 51, the weft thread 19 slides into its desired position on the half stitch 50. This movement of the weft thread 19 is indicated by arrow 52 in FIG. 7. The desired position of the weft thread 19 is indicated by a circle 53 in a dashed line.

In doing so, the correct operation of the stitch forming system is ensured even when very dense knitted goods are to be produced or, for example, when the half stitch 50 is very small due to an only minimal take-off tension. In any event, the weft thread 19 is guided into its desired position because of the guide projection 40. Consequently, the needle 26 has a large weft thread capture range, thus ensuring a reliable and low-wear operation of the crochet galloon machine.

A crochet galloon machine needle 26 in accordance with the invention is provided on its hook outside 39 with a guide projection 40 having a tip 43 that is preferably located above the center axis A of the needle 26. This needle 26 has an enlarged weft thread capture range and is thus particularly suitable for the manufacture of dense knitted goods. In addition, said needle enables the operation with reduced take-off tension and, optionally, also with reduced weft thread tension. This helps increase the service life of all system components.

It will be appreciated that the above description of the present invention is susceptible to various modifications, changes and modifications, and the same are intended to be comprehended within the meaning and range of equivalents of the appended claims.

LIST OF REFERENCE NUMERALS

10 Knitted good
11 First stitch chain
12 Second stitch chain
13 Third stitch chain
14 Fourth stitch chain
15 First ground thread
16 Second ground thread
17 Third ground thread
18 Fourth ground thread
19 Weft thread
20 Warp thread
21 Guide needles
22 First bar
23 Guide needles
24 Second bar
25 Thread guide
26 Needle(s)
27 Needle bed
28 Shank
A Center axis
29 Stitch forming part
30 Lower narrow side
31 Needle upper side
32 Transition point
33 Hook
34 Inside space
35 Extension
36 Hook head
37 Hook inside
38 Center
39 Hook outside
40 Guide projection
41 Ramp
42 Upper side
43 Tip
44 Intersection point
45 Point
46 Leg
47 End
48 Flank
49 Flank
50 Half stitch
51 Arrow
52 Arrow
53 Circle—desired position of weft thread
54 Needle channel
55
56
57
58
59
60

What is claimed is:

1. Crochet galloon machine needle comprising:

a shank having, on its one end, a hook with a hook head that transitions into a resilient leg that extends straight rearward with its end resting against a flank of the shank and closing a hook inside space, wherein the hook head has a hook inside facing toward the hook inside space and a hook outside facing away from the shank, and wherein a guide projection is formed on the hook outside with the guide projection having a straight upper side extending from a rounded tip of the guide projection toward the leg, and with the rounded tip being above a center axis of the needle.

2. Crochet galloon machine needle as in claim 1, wherein the hook inside is curved in the form of a circular arc around a center.

3. Crochet galloon machine needle as in claim 1, wherein the guide projection has a straight ramp extending from the rounded tip of the guide projection toward a lower narrow side of the needle.

4. Crochet galloon machine needle as in claim 2, wherein the guide projection has a straight ramp extending from the tip of the guide projection toward a lower narrow side of the needle, and a straight line applied to the upper side and a straight line applied to the ramp intersect in a point, said point being located above the center axis (A) extending through the center.

5. Crochet galloon machine needle as in claim 1, wherein the guide projection has flat flanks.

6. Crochet galloon machine needle as in claim 5, wherein the flat flanks are oriented parallel to each other.

7. Crochet galloon machine needle as in claim 2, wherein the guide projection has flanks converging toward the tip and toward each other.

* * * * *